US005274974A

United States Patent [19]

Haag

[11] Patent Number: 5,274,974

[45] Date of Patent: Jan. 4, 1994

[54] CAPS FOR ROOF-TO WALL CONNECTIONS, EAVE CLOSURES AND MEANS FOR INSTALLATION THEREOF

[76] Inventor: E. Keith Haag, 1007 W. Steels Corners Rd., Cuyahoga Falls, Ohio 44223

[21] Appl. No.: 875,097

[22] Filed: Apr. 28, 1992

Related U.S. Application Data

[63] Continuation-in-part of Ser. No. 792,356, Nov. 14, 1991.

[51] Int. Cl.[5] ..... E04B 2/00; E04B 7/00

[52] U.S. Cl. ..... 52/300; 52/283; 52/284; 52/220.1; 52/766; 52/92.1; 52/93.1

[58] Field of Search ..... 52/90, 94, 95, 79.5, 52/79.9, 79.11, 79.13, 259, 260, 262, 263, 271, 272, 278, 283, 285, 289, 300, 761, 766, 698, 699, 743, 745.05, 745.13, 745.21, 582, 586, 284, 275, 220, 221, 716.4, 716.6, 716.7, 716.8, 718.01, 718.04, 73, 91, 92, 127.11

[56] References Cited

U.S. PATENT DOCUMENTS

| | | | |
|---|---|---|---|
| 1,998,448 | 4/1935 | Crowe . | |
| 2,850,771 | 9/1958 | Wagner . | |
| 2,918,151 | 12/1959 | Kennedy . | |
| 3,150,463 | 9/1964 | Nearing et al. | 52/94 X |
| 3,196,499 | 7/1965 | Houvener | 52/90 X |
| 3,229,431 | 1/1966 | Paul . | |
| 3,284,966 | 11/1966 | Bolt . | |
| 3,344,564 | 10/1967 | Siegal | 52/90 X |
| 3,388,514 | 6/1968 | Archinal et al. . | |
| 3,397,494 | 8/1968 | Waring . | |
| 3,397,496 | 8/1968 | Sohns . | |
| 3,423,891 | 1/1969 | Burris . | |
| 3,436,881 | 4/1969 | Schlecht | 52/582 X |
| 3,452,498 | 7/1969 | Kinsey | 52/94 X |
| 3,641,720 | 2/1972 | Berrie | 52/586 X |
| 3,662,507 | 5/1972 | Espeland . | |
| 3,720,030 | 3/1973 | Krodel | 52/716.7 X |
| 3,738,083 | 6/1973 | Shimano . | |
| 3,783,563 | 1/1974 | Moore . | |
| 3,828,502 | 8/1974 | Carlsson . | |
| 3,866,381 | 2/1975 | Eschbach et al. . | |
| 3,897,967 | 8/1975 | Barenyi | 52/716.7 X |
| 3,921,354 | 11/1975 | Connelly et al. | 52/220 X |
| 3,952,461 | 4/1976 | Kinsey | 52/262 X |
| 3,992,839 | 11/1976 | LaBorde . | |
| 4,038,791 | 8/1977 | Atkinson | 52/73 X |
| 4,183,185 | 1/1980 | Farge . | |
| 4,261,143 | 4/1981 | Rizzo | 52/73 X |
| 4,557,091 | 12/1985 | Auer . | |
| 4,872,297 | 10/1989 | Hetzel et al. | 52/92 |

FOREIGN PATENT DOCUMENTS

| | | | |
|---|---|---|---|
| 4003276 | 8/1991 | Fed. Rep. of Germany | 52/220 |

*Primary Examiner*—Carl D. Friedman
*Assistant Examiner*—Robert J. Canfield
*Attorney, Agent, or Firm*—Renner, Kenner, Greive, Bobak, Taylor & Weber

[57] ABSTRACT

Cap means embodying the concepts of the present invention are adapted to secure one or more roof panel members to a modular building structure. Broadly, such a cap means has a horizontally disposed base portion that is adapted to engage a supporting member incorporated in, and presented from, the modular building. An inclined, plate portion is supported from the base portion. The plate portion is adapted to receive, and support, the roof panel. A locking member secures each roof panel to one or more inclined plate portions. The cap means may also provide a facia member which may be attached to the roof panels with connector that inhibit removal. The cap members can provide space for the installation of electrical cable in a location that can be accessed either before or after erection of the building.

5 Claims, 10 Drawing Sheets

CAPS FOR ROOF-TO WALL CONNECTIONS, EAVE CLOSURES AND MEANS FOR INSTALLATION THEREOF

CROSS REFERENCE TO RELATED APPLICATION

This application is a continuation-in-part of my U.S. application, Ser. No. 07/792,356, filed on Nov. 14, 1991, and captioned "Connector Means for Roof Panels and Method for Installation Thereof".

TECHNICAL FIELD

The present invention relates generally to modular building structures. More particularly, the present invention relates to cap means for modular building structures, the building structures to be constructed with a plurality of prefabricated structural components and being particularly adapted for use in third world countries. Specifically, the present invention relates to a novel connector means in the nature of cap members, which may incorporate an electrical race, for securing roof panel members to a wall. The cap members are particularly adapted for use in conjunction with modular building structures to serve as roof-to-wall connector means such that the roof may be erected in a relatively short time with the simplest of tools, and without the need for craftsmen skilled in the building trades. The cap members, or variations thereof, may also double as an eave closure which can also incorporate an electrical race.

BACKGROUND OF THE INVENTION

It is well known in the construction industry that significant economic savings can be realized by reducing the amount of work required at the construction site. To achieve this objective, prefabrication has been adopted on a large scale in the construction industry, both with respect to general purpose buildings and with respect to personal housing. For example, some sources have estimated that as many as forty percent (40%) of the homes now being built use some form of premanufactured structural components. Moreover, four and seven-tenths percent (4.7%) of all housing starts in the U.S. in 1991 are homes that are completely modular, and this percentage is expected to rise. The ultimate goal to be achieved in building modular structures has been to produce, at a remote site and in a factory environment, as many of the components of a given structure as possible, leaving only site preparation and final assembly to be done at the actual location where the building is to be situated.

There are a number of advantages to be achieved by prefabrication. The most obvious of those advantages is the significant reduction of time and labor required at the job site, where labor costs are normally the highest. In addition to the reduced time required for actual erection of the building, other time savings are also possible. For example, the reduced amount of work time at the job site reduces the potential for interruptions resulting from inclement weather. Reduced time at a job site can also drastically reduce the potential for work)related injuries and/or deaths. A controlled factory atmosphere is inherently amenable to measures for reducing injuries and increasing safety.

Furthermore, increased uniformity of the structural components resulting from the enhanced quality control possible in a factory atmosphere and the economic advantages of mass production techniques are also achievable with the prefabrication approach. As is often the situation, the use of standardized, prefabricated structural components not only improves the uniformity of the end product but also greatly simplifies the actual erection process. This last feature also makes it possible to produce quality buildings with unskilled, or minimally skilled, personnel. Thus, the overall results of prefabrication in the construction industry include greatly improved efficiency, significantly reduced costs, lower accident rates and better safety records.

These advantages are, of course, desirable in any type of construction but are believed to be especially important in the production of individual dwellings, particularly in economically distressed areas and in third world countries where cost is one of the most significant obstacles to overcome.

There are a wide variety of practical ways of to effectuate the prefabrication concept.

For example, the U.S. Patent to Crowe—U.S. Pat. No. 1,998,448—discloses the factory prefabrication of steel frame panel units of standard dimensions which are filled with cementitious material and assembled so as to leave vertical spaces between adjacent vertical walls for utility connection and with laterally adjacent panels being joined by cover strips or slabs which are interconnected thereto.

The U.S. Patent to Wagner—U.S. Pat. No. 2,850,771—discloses a prefabricated construction system wherein wooden panels are interconnected to vertical posts or columns with the vertical edges of the wooden wall panels and the posts having grooved areas and with spline blocks being used to interconnect the two.

The U.S. Patent to Paul—U.S. Pat. No. 3,229,431—is indicative of another approach wherein a so-called "frameless" modular multi-story building is constructed from self-contained prefabricated modules which are simply set on a building foundation and attached thereto by anchor bolts secured in the foundation.

The U.S. Patent to Bolt—U.S. Pat. No. 3,284,966—is of general interest in showing a prefabricated building which can be readily assembled or erected at the job site and which is collapsible for transportation purposes.

The U.S. Patent to Moore—U.S. Pat. No. 3,783,563—discloses a prefabricated building constructed of panels formed of molded plastic material, reinforced with glass fibers, and wherein the panels have channels or ribs on their edges adapted to mate with complementary structures of connector members.

Other examples of prefabricated construction components utilizing various plastic materials can be seen in the U.S. Patent to Kennedy—U.S. Pat. No. 2,918,151; the U.S. Patent to Espeland—U.S. Pat. No. 3,662,507; the U.S. Patent to Sohns—U.S. Pat. No. 3,397,496; and, the U.S.Patent to Farge—U.S. Pat. No. 4,183,185.

The foregoing patents are believed to be generally representative of the prior art, and that art does illustrate some diverse approaches to the prefabrication of buildings using various materials. However, none of the aforesaid prior art patents, nor any other prior art with which the inventor is aware, either alone or in combination, achieve the several objects of the present invention.

SUMMARY OF THE INVENTION

It is, therefore, a primary object of the present invention to provide improved cap means for roof-to-wall connections as well as for eave closures that are particularly well suited for modular building structures.

It is another object of the present invention to provide cap means, as above, which can be used structurally to join roof panel members to a supporting wall with relatively unskilled laborers, and without specialized tools.

It is a further object of the present invention to provide cap means, as above, that may incorporate an electrical race.

It is a still another object of the present invention to provide cap means, as above, which permit the erection, and connection, of roof panel members to their supporting structure and to each other in a far shorter period of time than heretofore possible.

It is yet another object of the present invention to provide a cap means, as above, which can be mass produced at relatively modest expense and can then be conveniently shipped to a remote construction site, also at relatively modest cost.

It is yet a further object of the present invention to provide a cap means, as above, that can serve as an eave closure and which also permits roof panel members to be erected with a much reduced number of work-related injuries and/or deaths than with more traditional construction methods.

It is still further object of the present invention to provide cap means, as above, that may be prefabricated in a controlled working environment that inherently leads to reduced injuries and increased safety.

It is an even further object of the present invention to provide cap means, as above, that may employ an optional interlocking structure which will impede removal of the cap means, or variations thereof, particularly when the cap means is employed as an eave closure.

These and other objects of the invention, as well as the advantages thereof over existing and prior art forms, which will be apparent in view of the following detailed specification, are accomplished by means hereinafter described and claimed.

In general, a cap means embodying the concepts of the present invention is adapted to secure one or more roof panels to the wall of a modular building structure. Broadly, such a cap means has a horizontally disposed base that is adapted to engage a supporting member incorporated in the modular building. An inclined, plate portion is supported from the base. The plate portion is adapted to receive, and support, a roof panel. A locking member frictionally secures each roof panel to the inclined plate portion. The same cap means can also be employed as an eave closure.

The present invention is described in conjunction with two exemplary embodiment of cap means for roof-to-wall connections and two embodiments of cap means for closing eaves—which four embodiments are deemed sufficient to effect a full disclosure of the subject invention. The exemplary connector means are described in detail without attempting to show all of the various forms and modifications in which the invention might be embodied; the invention being measured by the appended claims and not by the details of the specification.

DESCRIPTION OF AN EXEMPLARY EMBODIMENT

One representative form of a cap for a roof-to-wall connection embodying the concepts of the present invention is designated generally by the numeral 10 in FIGS. 1 through 5 of the accompanying drawings. The representative roof-to-wall cap connector means 10 may, for example, be employed in a building structure which could serve as residential living quarters.

Figure 1:
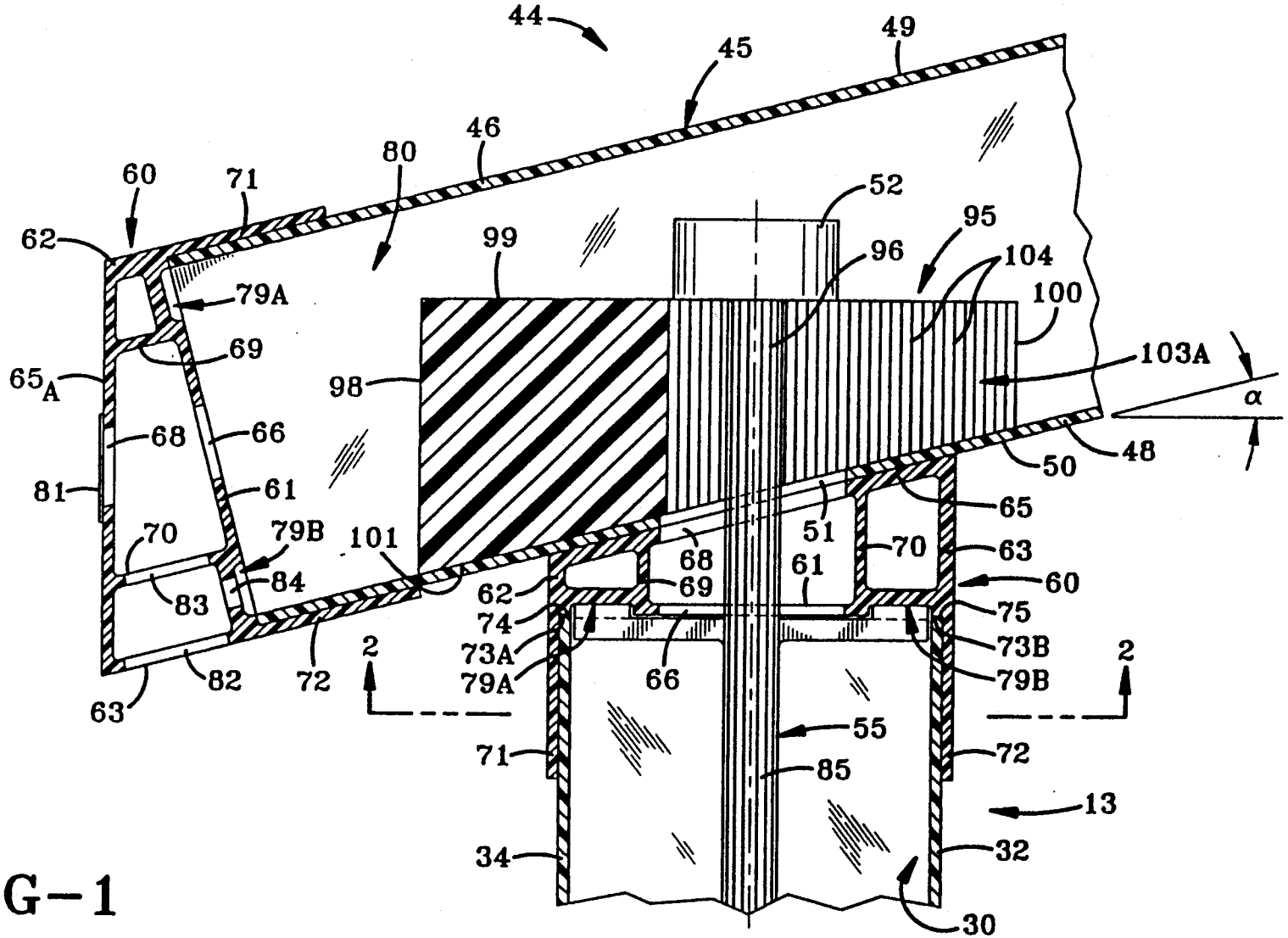
FIG. 1 is a vertical section through one form of a roof-to-wall connection embodying the concepts of the present invention.
Figure 2:
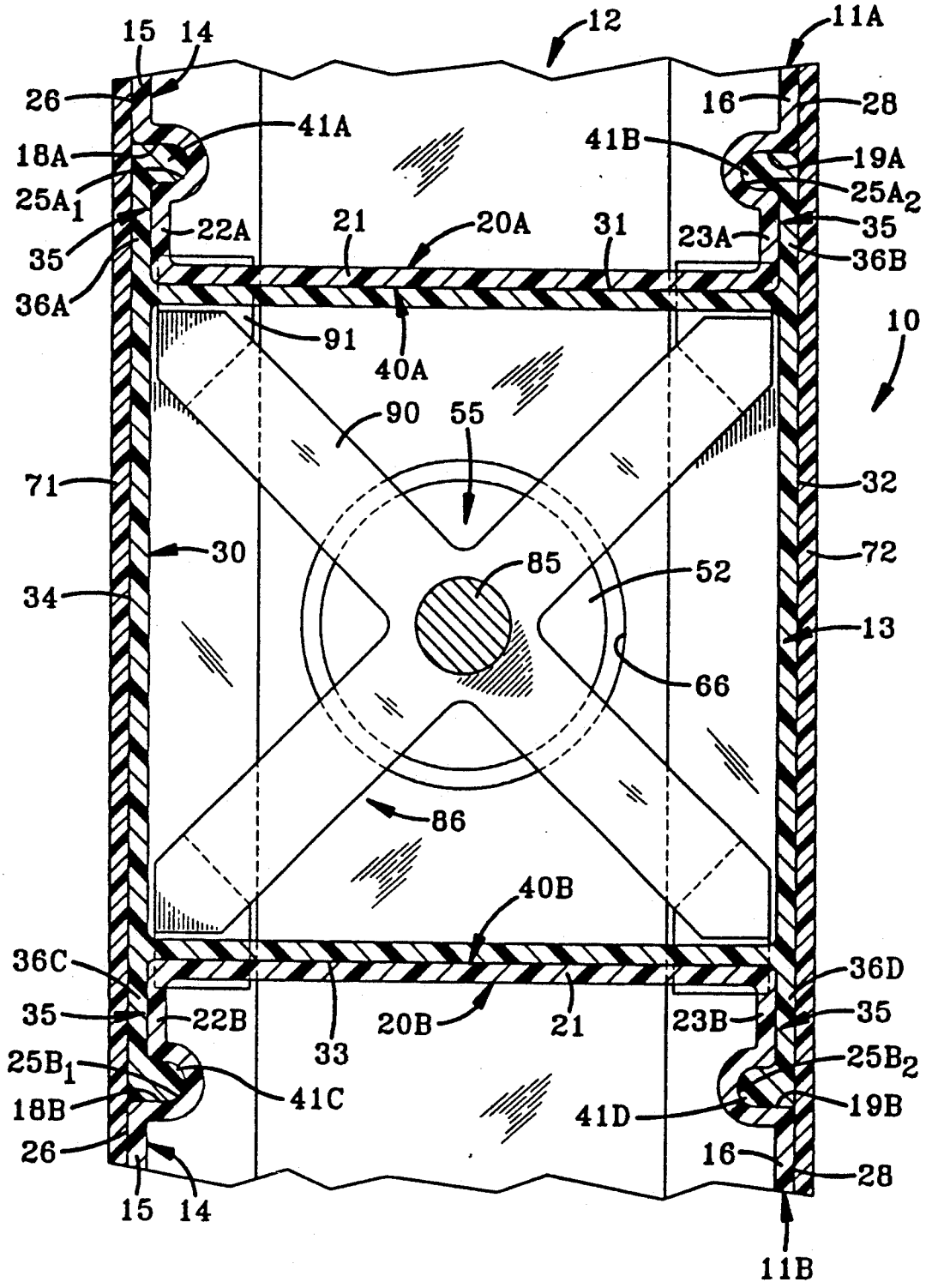
FIG. 2 is a horizontal section taken substantially along line 2—2 of FIG. 1 and looking upwardly at a portion of the structure by which the roof-to-wall connection is effected.
Figure 3:
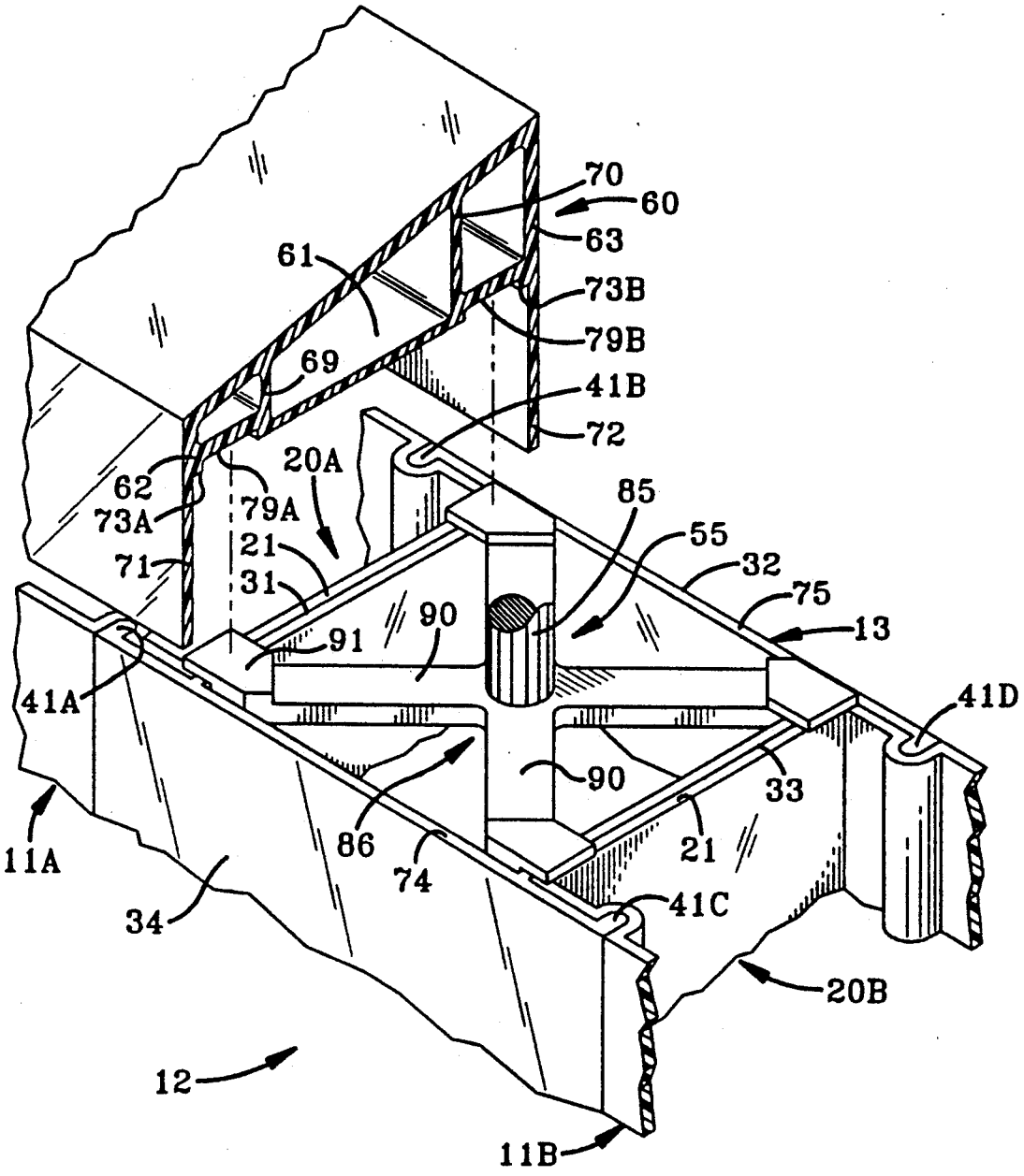
FIG. 3 is an exploded perspective of the roof-to-wall connection depicted in FIGS. 1 and 2 which is presented to depict the structural interaction between the components forming that connection.
Figure 5:
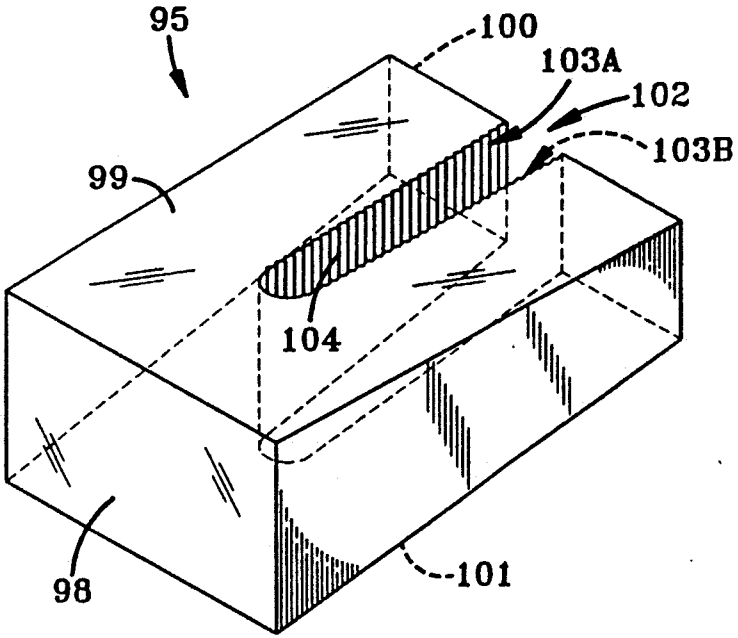
FIG. 5 is a perspective representation of one form of an anchor block employed in the roof-to-wall connection of the present invention.

With particular reference to FIGS. 1 and 2, the composite structure which constitutes the principal component of the walls, and even the roof, of the modular building structure for which the present connector means assembly is particularly suited is the panel member 11. That portion of the wall 12 represented in FIG. 2 is formed by two, longitudinally aligned panel members 11A and 11B which are joined by a panel connector 13.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation by which that structural member, component or arrangement is generally identified. Thus, there are at least two panel members which are generally identified by the numeral 11, but the specific, individual panels are, therefore, identified as panel members 11A and 11B in the specification and on the drawings. This same suffix convention shall be employed throughout the specification.

Returning to the description of the arrangement depicted in FIG. 2, the wall panel members 11 each have a body portion 14. The body portion 14 has planar, transversely spaced, substantially parallel, skin walls 15 and 16. A plurality of reinforcing ribs, not shown, preferably extend transversely between the skin walls 15 and 16. The ribs are, themselves, laterally spaced, one with respect to the others, and they are oriented substantially parallel to the lateral edges of the body portion 14—i.e., perpendicularly with respect to the skin walls 15 and 16.

The longitudinal edges of the body portion 14 are delineated by positioning shoulders 18 and 19 presented at the opposite ends of each skin wall. As depicted in FIG. 2, a positioning shoulder 18A defines one longitudinal edge of skin wall 15 on panel 11A, and a corresponding, and laterally spaced, positioning shoulder 19A defines one longitudinal edge of skin wall 16 of panel 11A. The positioning shoulders 18A and 19A thus define one longitudinal edge of the body portion 14 on panel 11A as well as the offset juncture between the body portion 14 and the connecting tongue 20A which extends longitudinally outwardly from that vertical edge of the body portion 14 on panel 11A defined by the positioning shoulders 18A and 19A.

Similarly, a positioning shoulder 18B defines the opposite longitudinal edge of skin wall 15 on panel 11B, and a corresponding, and laterally opposed, positioning shoulder 19B defines the opposite longitudinal edge of wall skin 16 on panel 11B. The positioning shoulders 18B and 19B are laterally spaced from each other, and longitudinally opposed to the positioning shoulders 18A and 19A on panel 11A. As in panel 11A, the positioning shoulders 18B and 19B define one longitudinal edge of the body portion 14 on panel 11B as well as the offset juncture between the body portion 14 and the connecting tongue 20B which extends longitudinally outwardly from that longitudinal edge of the body portion 14 on panel 11B defined by the positioning shoulders 18B and 19B.

The connecting tongues 20 each have a transversely oriented closure wall 21 that is spaced longitudinally outwardly from the longitudinal edge of the body portion 14 defined by the positioning shoulders 18 and 19. The transverse edges of the closure wall 21 are joined to transversely spaced, longitudinally extending, locking walls 22 and 23. A vertically extending locking groove 25 is recessed into each connecting tongue 20 between each locking wall 22 and 23 and the body portion 14 such that locking grooves $25A_1$ and $25A_2$ lie parallel to shoulders 18A and 19A, respectively, of panel 11A. Similarly, locking grooves $25B_1$ and $25B_2$ lie parallel to shoulders 18B and 19B of panel 11B.

The pair of tongues 20A and 20B presented from the longitudinal edges of the linearly aligned panels 11A and 11B, respectively, have a transverse thickness that is less that the transverse thickness of the body portion 14 in either panel member 11.

Specifically, the locking walls 22 are laterally offset with respect to the longitudinally and vertically oriented plane within which the exposed surface 26 on skin wall 15 is disposed, and the locking walls 23 are laterally offset with respect to the longitudinally and vertically oriented plane within which the exposed surface 28 on skin wall 16 is disposed. It is these lateral offsets of the locking walls 22 and 23 relative to the respective surfaces 26 and 28 on the two skin walls 15 and 16 which results in the transverse, or laterally measured, thickness of the tongues 20 being less that the transverse, or laterally measured, thickness of the body portion 14 on either panel member 11A or 11B. The functional purpose for this deliberate disparity between the transverse thickness of the tongues 20 relative to the transverse thickness of the body portion 14 in each panel member 11 accommodates the panel connector 13, as will now be explained.

With continued reference to FIG. 2, the panel connector 13 is employed to effect a structural tie between the two, linearly oriented panel members 11A and 11B. Typically, a panel connector 13 has a body portion 30 that is preferably of box-shaped cross section. That is, the body portion 30 is hollow and has a generally rectilinear, external periphery which defines a plurality of exterior faces such as the four 31, 32, 33 and 34 depicted. The box-shaped cross section provides excellent bending strength with minimal material as well as excellent columnar strength with a superb L/R ratio.

Connecting flanges 35 are presented from the body portion 30 in oppositely extending pairs. Each flange 35 has an extension arm 36 with ends that are proximal and distal with respect to the body portion 30 from which each extension arm 36 is presented. The proximal end portion of each extension arm 36 is integral with the body portion 30 in such a manner that each extension arm is oriented in perpendicular relation with respect to one adjacent face but also in longitudinal alignment—i.e.: coplanar—with another face on the body portion 30.

As can be seen with reference to FIG. 2, the extension arm 36A is oriented not only in perpendicular relation with respect to the exterior face 31 but also in coplanar relation with respect to exterior face 34. Likewise, the extension arm 36B is oriented not only in perpendicular relation with respect to the exterior face 31 but also in coplanar relation with respect to the exterior face 32. The extension arms 36A and 36B are thus disposed in transversely spaced, parallel relation to form the first connection receptacle 40A.

A locking pawl 41 extends transversely outwardly from the distal end portion of each extension arm 36. Specifically, locking pawl 41A is presented from the distal end portion of the extension arm 36A, and pawl 41B is presented from the distal end portion of the extension arm 36B. The pawls 41A and 41B so provided extend toward each other in facing opposition in the first connection receptacle 40A.

The panel connector 13 also presents a second pair of extension arms 36C and 36D which extend outwardly from the body portion 30 in a diametrically opposite direction relative to the first pair of extension arms 36A and 36B, respectively. As such, the extension arm 36C is oriented not only in perpendicular relation with respect to the exterior face 33 but also in coplanar relation with respect to the exterior face 34. Likewise, the extension arm 36D is oriented not only in perpendicular relation with respect to the exterior face 33 but also in coplanar relation with respect to the exterior face 32. The extension arms and 36C and 36D are thus disposed in transversely spaced, parallel relation to form the second connection receptacle 40B which extends longitudinally outwardly from the panel connector 13 in the diametrically opposite direction from connection receptacle 40A.

A locking pawl 41C also extends transversely outwardly from the distal end portion of extension arm 36C, and a locking pawl 41D extends transversely outwardly from the distal end of extension arm 36D. The locking pawls 41C and 41D thus also extend toward each other in facing opposition within the connecting receptacle 40B.

The heretofore defined wall panel members 11 and the panel connectors 13 permit the wall 12 to be either directly assembled in their final, vertical disposition, or assembled at ground level and then raised into their final, vertical position. Either approach is acceptable, but there will likely be those who prefer one method over the other.

To erect a wall 12 in situ at least one laborer will require a ladder, stilts or some form of scaffolding. In this situation two sequential panel members 11A and 11B may be positioned in linear juxtaposition, and the laborer on the scaffolding, or the like, may take a coupling connector 13 and slide it vertically between the linearly juxtaposed panel members 11A and 11B such that, as depicted in FIG. 2, the connecting receptacle 40A on the panel connector 13 operatively engages the connecting tongue 20A on panel 11A and the connecting receptacle 40B on the panel connector 13 operatively engages the connecting tongue 20B on panel member 11B.

Operative engagement of the connecting receptacles 40 on the panel connector 13 with the tongues 20 on the panel members 11 requires that the locking pawls 41 in the connection receptacles 40 mesh with the locking grooves 25 associated with each the connecting tongue 20. In fact, the locking pawls 41 are slidably received within the locking grooves 25. So engaged, the panel member 11A and 11B are fully tied to the panel connector 13, and thus to each other.

Continued reference to FIG. 2 will also reveal the functional purpose of having the connecting tongues 20 of lesser transverse thickness than the thickness of the body portion 14 of the panel members 11 from which the tongues 20 are presented. By making the transverse offset between each locking wall 22 and 23 and the appropriate skin wall 15 or 16 on the panel members 11 equal to the transverse thickness of the extension arm 36 of the panel connector 13, the faces 34 and 32, respectively, on the body portion 30 of the panel connector 13 will be located coplanar with the surface of the skin walls 15 and 16 on the panel members 11. With all the transverse offsets between the skin walls 15 and 16 on the panel members 11 and the corresponding locking walls 22 and 23 on the connecting tongues 20 being so dimensioned, both sides of the wall 12 defined by the skin walls 15 and 16 on successive panel members 11 across the length of the wall 12 will be virtually flush with each other and with the appropriate faces 34 and 32 on the panel connectors 13 used to interconnect the panel members 11.

The panel members 11, as well as the panel connectors 13 described above, as well as those structural members which will be hereinafter described, may well comprise an extruded thermoplastic resin. Such resins are preferably reinforced with fibers such as glass fibers and provide a material commonly referred to as a fiber-reinforced plastic (FRP). While a variety of thermoplastic materials and fiber reinforcements are known, one particularly suitable FRP comprises vinyl chloride resins reinforced with glass fibers.

The amount of fiber reinforcement in such a product can range: broadly from about five to fifty percent (5% to 50%) by weight, based upon the combined weight of glass fibers and vinyl chloride resin; desirably from about ten to forty percent (10% to 40%) by weight; preferably about fifteen to thirty-five percent (15% to 35%) by weight; and, most preferably about thirty percent (30%) by weight. A good disclosure of these products and the process for their preparation can be found in U.S. Pat. No. 4,536,360, the subject matter of which is incorporated herein by reference.

As should be evident to those skilled in the art, practice of the present invention does not require that the structural components comprise vinyl chloride resins reinforced by glass fiber and therefore, the invention is not to be limited thereto or by the disclosure of U.S. Pat. No. 4,536,360. Thus, the structural components may not be fiber reinforced or even thermoplastic so long as they can be manufactured in the configurations described herein.

As noted previously, composite panel members 11 may also constitute the principal component of the roof 44. To preclude confusion the panel members shall, when used as a component of the roof itself, be designated by the numerical identifier 45. The roof panel members 45 are, as depicted in FIG. 1, connected to, and supported by, the wall 12, the structural arrangement for which has now been described. The roof panel member 45 also has opposed skin walls 46 and 48, skin wall 46 presenting the exterior surface 49 of the roof panel 45, and skin wall 48 presenting that surface 50 which faces interiorly of the structure covered by the roof panel members 45.

With additional reference to FIG. 1 it will be observed that an aperture 51 penetrates the skin wall 48 presenting the interior surface 50 on the roof panel member 45. The aperture 51 is of sufficient dimension to be readily received over the locking head 52 of an anchor dowel 55, as will be hereinafter described in greater detail.

As can be seen from FIG. 1, a roof-to-wall connector cap 60 serves to determine the pitch at which the roof panel member 45 is inclined with respect to the vertically disposed wall 12. Each such connector cap 60 has a horizontal base 61, and a vertically oriented, short riser 62 is conjoined to the base 61 at approximately the outer extent of the base. A vertically oriented, long riser 63 is similarly conjoined at the inner extent of the base 61. The difference in the vertical extent of the risers 62 and 63 determines the pitch at which the roof panel member 45 is inclined, as should now be apparent. An inclined plate portion 65 is disposed in spaced relation upwardly of the base 61 and may be integral with the risers 62 and 63.

The base 61 and the inclined plate portion 65 are each provided with respective apertures 66 and 68. The apertures 66 and 68 are aligned and are also of sufficient dimension to permit the locking head 52 of the anchor dowel 55 to be received therethrough. Reinforcing walls 69 and 70 extend substantially vertically between the base 61 and the inclined plate portion 65, and they are preferably disposed in parallel relation to the risers 62 and 63. Although only two reinforcing walls 69 and 70 are depicted in the drawings, it should be understood that the space which extends vertically between the apertures 66 and 68 may be surrounded by reinforcing walls in order to provide additional strength to the connector cap 60, if required, or desired.

A pair of mounting flanges 71 and 72 extend downwardly from the base 61, and they are preferably disposed in alignment with the risers 62 and 63, respectively, and are laterally spaced contiguously to engage the surfaces 34 and 32 on the body portion 30 of the panel connector 13 as well as the exposed surfaces 26 and 28 (FIG. 2) on the skin walls 15 and 16 of each panel member 11. As such, the cap member 60 embracingly engages the wall panels 11A and 11B, as they are conjoined by the panel connector 13, as well as the panel connector 13 itself. This configuration assures that the cap member 60 will effect alignment of the successive panel members 11 engaged by the cap member 60 during erection of the wall 12.

At the juncture of each mounting flange 71 and 72 with the base 61 is an engaging step 73. When the end cap 60 is received on the panel member(s) 11 forming the wall 12, the steps 73A and 73B engage the upwardly directed edges 74 and 75, respectively, of the walls 34 and 32 on the connector 13 as well as the upwardly directed edges 76 and 78 (FIG. 4) of the coplanar walls 15 and 16 on the wall panel members 11. The steps 73 thus serve to effect accurate placement of the cap 60 with respect to the wall 12 on which it is received.

A pair of longitudinally extending recesses 79A and 79B are formed in the base 61. The recesses 79A and 79B may, as represented, be respectively disposed in proximity to the engaging steps 73A and 73B. The recesses 79 serve to align, and position, the anchor dowel 55, as will be hereinafter more fully explained.

The utilization of one component for multiple purposes also enhances the concept of modularity. An excellent example of this multiple utilization is that the cap member 60 can not only be employed along the upper extent of the panel members 11 forming the wall 12 but also along the outer edge of the roof panel members 45 which form the roof 44, where the plate portion 65 becomes the fascia $65_A$ (FIG. 1). The apertures 66 and 68 which accommodate the locking head 52 of the anchor dowel 55 then serve as ventilation openings to the interior cavity 80 of the roof panel 45. In that situation at least the outer aperture 68 may be provided with a screen 81, or other means, by which to preclude the admission of bugs, birds or rodents. To provide a means by which to drain any undesired liquid from accumulating within the cavity 80, apertures 82 and 83 may penetrate the long riser 63 and the reinforcing wall 70, respectively, and an aperture 84 may penetrate the base 61 and open through the recess 79B adjacent the long riser 70.

Figure 4:
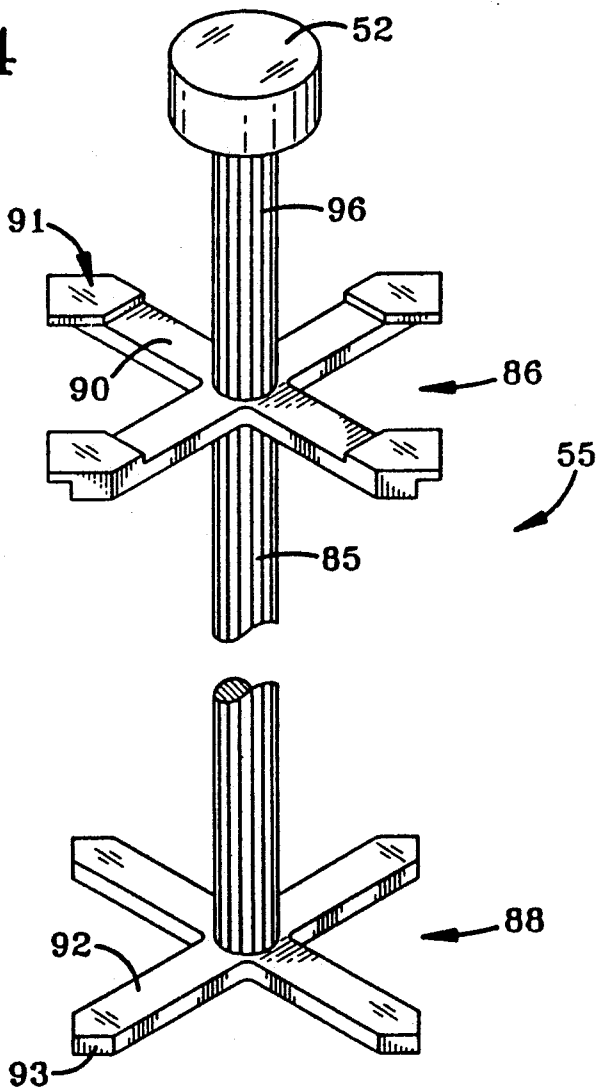
FIG. 4 is a perspective view of one form of an anchor dowel employed as a component of the roof-to-wall connection embodying the concept of the present invention.

Returning to the description of the roof-to-wall connector arrangement, the anchor dowel 55 has a body portion 85 the upper extent of which terminates in a locking head 52 which has at least one transverse dimension that is greater than a corresponding transverse dimension of the of body portion 85. As best seen in FIG. 4, the body portion 85 as well as the locking head 52 may both be cylindrical, although the specific configuration is not critical.

The anchor dowel 55 has two positioning arrays, a vertically upper array 86, and a lower array 88, which assure that the body portion 85 is located centrally with respect to the cavity 89 (FIGS. 1 and 3) within the connector 13. The upper array 86 may employ four individual arms 90 which extend radially outwardly from the body portion 85, each of which terminate in an engaging tab 91. The arms 90 are preferably spaced at angular increments of 90 degrees about the circumference of the body portion 85, and each engaging tab 91 is angularly disposed with respect to the axis of the arm 90 from which it is presented so as to engage one of the recesses 79A or 79B (FIGS. 1-3) formed in the end cap 60. The engaging tabs 91 also fit between the base 61 (within the appropriate recess 79) of the end cap 60 and the closure wall 21 of the appropriate tongue 20.

The lower array 88 may also employ four individual arms 92 (FIG. 4) which extend radially outwardly from the body portion 85, each of which terminate in an engaging wedge 93. The arms 92 are also preferably spaced at angular increments of 90 degree about the circumference of the body portion 85. The engaging wedges 93 are each received within the included angle formed by the intersection of the sides 31, 32, 33 and 34 forming the body portion 30 of the panel connector 13. The lower array 88 is preferably located at the very bottom of body portion 85. The vertical distance between the upper and lower arrays 86 and 88 may be selected to assure that the lower array 88 may be buried to a sufficient extent within whatever cementitious material is introduced into the cavity 89 of the connector 13 in order to provide the desired resistance against lifting of the roof structure off the supporting wall 12 and also to permit a close fit between the end cap 60 and the components of the upper array 86. When those conditions are met, the vertical distance between the upper array 86 and the locking head 52 will accommodate an anchor block 95 (FIGS. 1 and 5) which is interposed between the locking head 52 and the plate portion 65 of end cap 60 to tie the roof panel 45 to the wall 12, as will be hereinafter described in greater detail. Although the interaction of the anchor block 95 with the anchor dowel 55 provides a facile means by which to secure the roof panel 45 to the wall 12, it is not the only means by which to effect that connection. Should one employ the anchor block 95, however, the surface on that length of the anchor dowel body portion 85 which extends between the locking head 52 and the plate portion 65 of the end cap 60 is preferably provided with vertical striations 96 cooperatively to interact with an anchor block 95, as will be hereinafter more fully described.

The anchor block 95 is generally wedge shaped, with a trapezoidal, vertical cross-section as best seen in FIG. 1. Three sides of this trapezoidal cross-section—i.e.: sides 98, 99 and 100—are perpendicular to each other, but the remaining side 101 is inclined at angle equal to the pitch $\alpha$ of the roof 44. The anchor block 95 has a central slot 102 which opens through side 100. The lateral sides 103A and 103B of the slot 102 has vertical striations 104 which are lockingly engageable with the striations 96 on the body portion 85 of the anchor dowel 55.

As should now be readily understood, when the anchor dowel 55 is secured within the connector 13 the locking head 52 and a length of the body portion 85 will extend upwardly through the aperture 68 in the plate portion 65 so that an aperture 51 in the skin wall 48 of the roof panel 45 can be received over the locking head 52. When the interior surface 50 on the skin wall 48 thus contiguously engages the plate portion 65, an anchor block 95 will be inserted into the cavity 80 of the roof panel 45 (the end cap 60 not yet having been positioned on the roof panel 45). A workman need only position the slot 102 in alignment with that length of the body portion 85 which extends into the cavity 80 of the roof panel 45 and then drive the anchor block 95 wedgingly between the locking head 52 and the plate portion 65. The interaction of the striations 96 on the body portion 85 of the anchor dowel 55 and the striations 104 on the anchor block 95 maintains the wedging action of the anchor block 95 and thereby secures the roof panel 45 to the wall 12.

The end cap 60 may then be applied to the roof panel 45. As shown in FIG. 1, the end cap 60 may be applied by fitting the mounting flanges 71 and 72 embracingly to engage the skin walls 46 and 48 on the roof panel 45. The end cap 60 may be retained by an adhesive or other fastening means.

Figure 6:
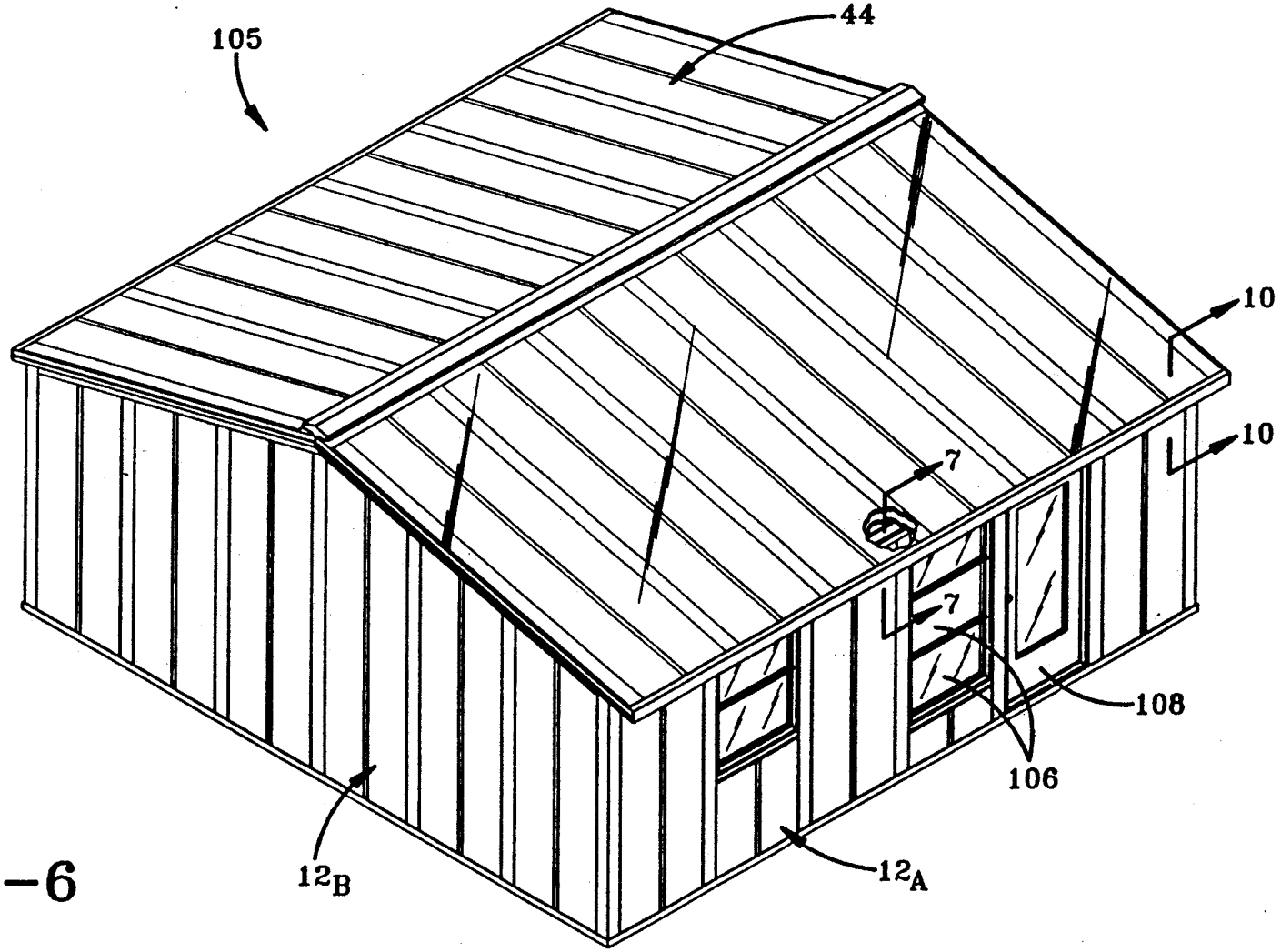
FIG. 6 is a perspective view of a representative building incorporating the structural components of the present invention.

A building 105, shown in FIG. 6, employs the unique structures of the present invention. The building 105 may have exterior support walls $12_A$ and end walls $12_B$. Windows 106 and one or more doors 108 may be installed in one or more of the walls, such as the outer wall $12_A$, as depicted. The roof 44 is supported on, and secured to, the outer walls $12_A$ by virtue of a cap connector means 10, such as heretofore described. An alternative end cap connector means 110 will now be described.

The cap connector 110 (FIGS. 7, 8A and 8B) has first and second mounting flanges 111 and 112, respectively, which are laterally spaced to embrace the skin walls 15 and 16 of the panel members 11. The mounting flanges 111 and 112 are interconnected by a base wall 113. The base wall 113 and an inclined plate 114 (or fascia when the cap is used as an eave closure, as will be hereinafter described in detail), are interconnected by a first, or short, riser 115, a first, or short, reinforcing wall 116 and a second, or longer, reinforcing wall 118. The inclined plate 114 may include first and second step portions 119 and 120 as well as a central, generally flat portion 121, and, as shown, the step portions 119 and 120 may be offset with respect to the central portion 121. The first offset step portion 119 connects the first riser 115 to the first reinforcing wall 116. The second offset portion 120 is connected between the second reinforcing wall 118 and an extension wall 122. As shown, the extension wall 122 may be aligned with the first mounting flange 111 such that were it continuous, as in cap 60, the extension wall 122 would serve as a second, or longer, riser.

The base wall 113 also has a central plate portion 123 disposed between laterally spaced first and second offset steps 124 and 125, respectively. The first step 124 is connected between the joinder of the first mounting flange 111 and the first riser 115 and extends laterally to intersect the first reinforcing wall 116. The second step 125 extends laterally between the second mounting flange 112 and the second reinforcing wall 118. A lateral wall 126 extends between the second reinforcing wall 118 and the extension wall 122. The second reinforcing wall 118, the second step 125 and the lateral wall 126 cooperate to form an elongated channel, or race, 130 to receive electric wiring, such as the cable 127 depicted in FIG. 7. It should be appreciated that additional walls may be added to, or some eliminated from, the cap connector without departing from the spirit of the invention.

The race 130 opens outwardly through an access aperture 131 (FIG. 8A) located between the second mounting flange 112 and the extension wall 122. As such, the access aperture 131 extends the length of the race 130, and the bounding edges of the access aperture 131 constitute opposed latching pawls 132 and 133. The access aperture 131 may be selectively closed by a race cover plate 135. The cover plate 135 has a substantially flat central portion 136 bounded by a pair of longitudinally extending, first and second latching rails 138 and 139. The latching rails 138 and 139 cooperatively interact with the latching pawls 132 and 133, respectively, to secure the cover plate 135 to the end cap 110 and close the race 130 from the elements. The cover plate 135 can be installed by engaging one latching rail 138 or 139 with the appropriate latching pawl 132 or 133 and then lightly tapping the cover plate 135 to force the other latching rail 139 or 138 into engagement with the other latching pawl 133 or 132. The cover plate 135 can also be installed before or after the cap connector 110 is secured to the wall $12_A$, either in the manner previously described, or by sliding the cover 135 longitudinally of itself, with the latching rails 138 and 139 engaged with the latching pawls 132 and 133.

Inasmuch as the connector cap 110 runs along the length of the building 105, the race 130 will permit easy installation of, and access to, any electrical cables 127 strung therein. The aforesaid concept makes it convenient to run the cable 127, even after the connector cap 110 is been installed in the building 105.

The connector cap 110 is mounted on the exterior support walls $12_A$ of the building 105 and may be secured thereto with the same structure described above for the end cap 60. That is, the anchor block 95 and anchor dowel 55 are secured in place. The apertures required for the use of the anchor dowel 55 are punched or otherwise formed in the connector cap 110 after the extrusion process is completed. It should be noted that when the roof panels 45 are extruded, there may be slight imperfections, such as a barely perceptible waviness, on the surface of the panel members. Such imperfections may become obvious when the panels 45 are supported on the connector cap 60. However, these slight imperfections will not be obvious if the offset steps 119 and 120 are employed. Because of the spacing that occurs between the steps 119 and 120 and the panel members 45, even with the panel members 45 fully supported on the central supporting surface 120 of the connector cap 110, any imperfection, or waviness, will not be visually apparent.

Consistent with the spirit of the present invention even the connector cap 110 exemplifies a structural element that may be utilized for multiple purposes to enhance the concept of modularity. Specifically, the connector cap 110 may also serve as an eave cap to close the open ends of the roof panel members 45. With some further variations, as shall now be explained, the need to utilize adhesives, or like means, to secure the eave cap 210 to the roof 44 may be obviated.

As is apparent from the foregoing description, the general shapes of the roof panel members 45 and wall panel members 11 are substantially identical. However, the roof panels 45 may be thicker than the wall panels 11. The difference in thickness can serve not only to enhance the beam strength of the roof panel members 45 but also to augment the insulating qualities of the roof panel members. Likewise, the panel connectors 13 may be sized to accommodate the thickness of the respective panels that are to be connected thereby.

Figure 9:
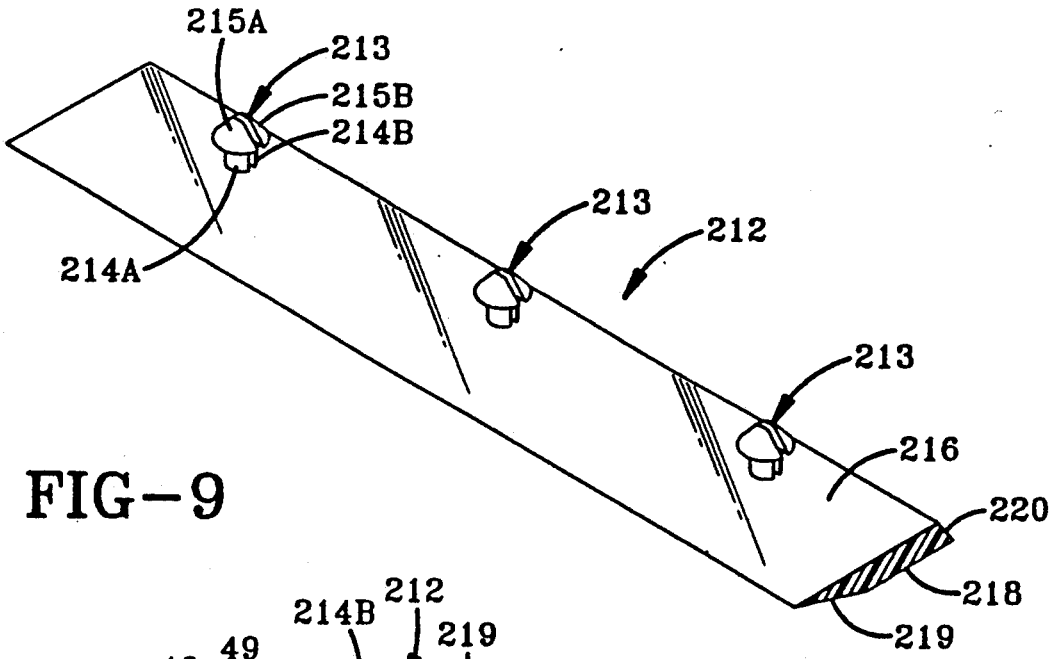
FIG. 9 is a perspective representation of an anchor strip that may be employed in conjunction with a roof-to-wall connection but which is particularly useful when the cap means is employed as an eave closure.

One novel means by which to secure the eave cap 210 to the roof panel members 45 is to provide a plurality of aligned, and spaced, apertures 211 (FIG. 10) that penetrate the skin walls 46 and/or 48 of the roof panel members 45, and which permit one or more anchor strips 212 to be attached to the roof 44. As shown in FIG. 9, the anchor strips 212 may be provided with a plurality of arrowhead tangs 213 that are formed integrally therewith. Each tang 213 includes a pair of spaced, flexible fingers 214A and 214B, each of which terminate in an expanded head portion 215A and 215B, respectively. The fingers 214 will be displaced, or deflected, toward each other as the head portions 215 on the fingers 214 of the tang 213 are forced into the apertures 211. After the head portions 215 pass through the apertures 211 they will snap apart such that the head portions 215 will be disposed adjacent the inner surface 216 or 218 on the respective skin walls 46 or 48 of the roof panel members 45 to prevent inadvertent removal of the anchor strips 212, as shown in FIG. 11B.

With reference again to FIG. 9, each anchor strip 212 preferably has a quadrilateral, transverse cross section with parallel side walls 216 and 218, a sloping leading edge wall 219 and a latching edge wall 220. The leading edge wall 219 will, as hereinafter more fully explained, serve as a cam so it preferably has a shallower slope than the latching edge wall 220. As shown, the two edge walls slope in opposite directions for a reason that will also become apparent. The anchor strips 212 may be installed as a single unit, or as a number of shorter units, along the exterior surface 49 on skin wall 46 and along what has been designated as the interior surface 50 on skin wall 48 of the roof panel members 45. The anchor strips 212 cooperate with the eave cap 210 to secure it to the outer edge of the roof panel members 45. The anchor strips 212 may also be fabricated from the same material as the roof and wall panels or they may be fabricated from other plastic materials that are available on the market.

Figure 10:
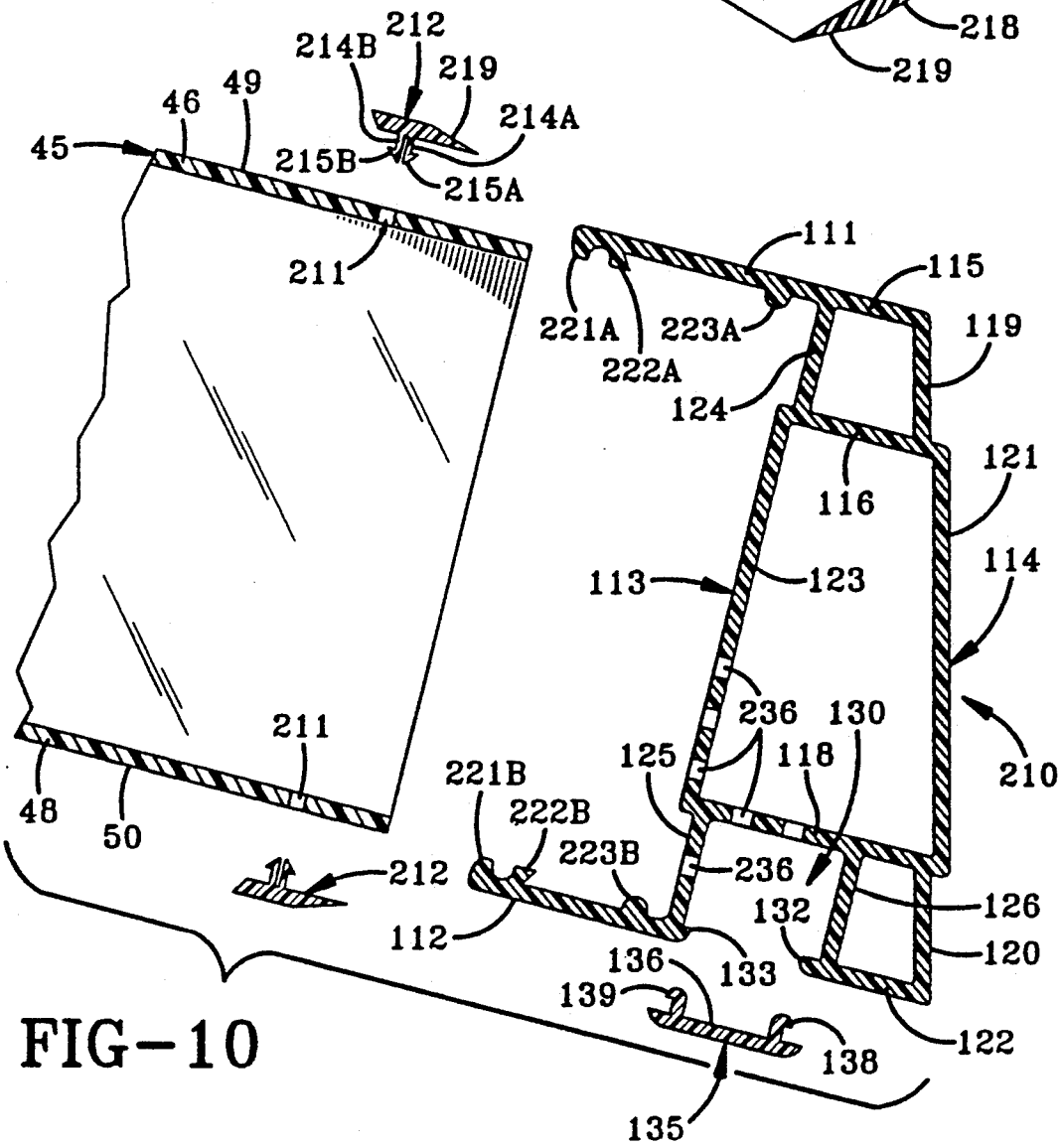
FIG. 10 is an exploded sectional view depicting the alternative embodiment of the cap means employed as an eave closure.
Figure 11A:
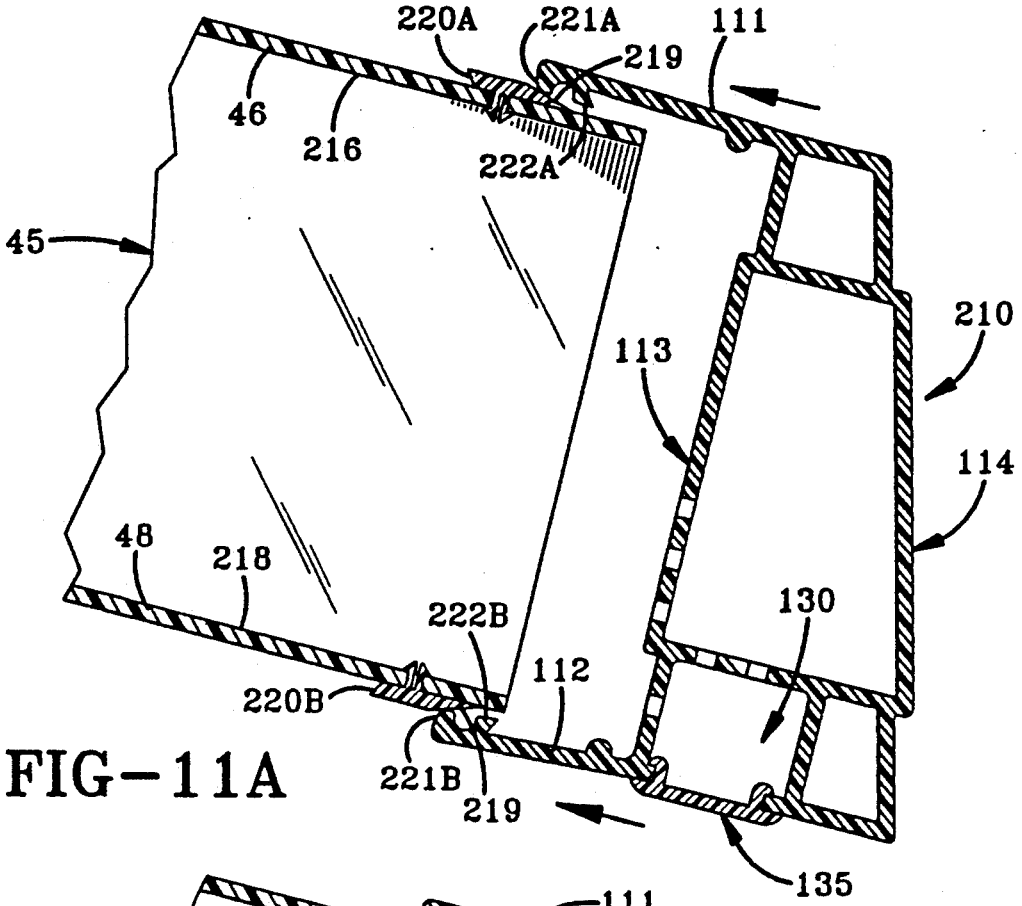
FIGS. 11A and 11B depicted the sequential steps by which an eave closure cap may be secured to a roof when the anchor strip depicted in FIG. 9 is secured to the roof panel member(s); and, FIG. 12 is a perspective, partly in section, of the eave closure cap depicted in FIG. 11B.
Figure 11B:
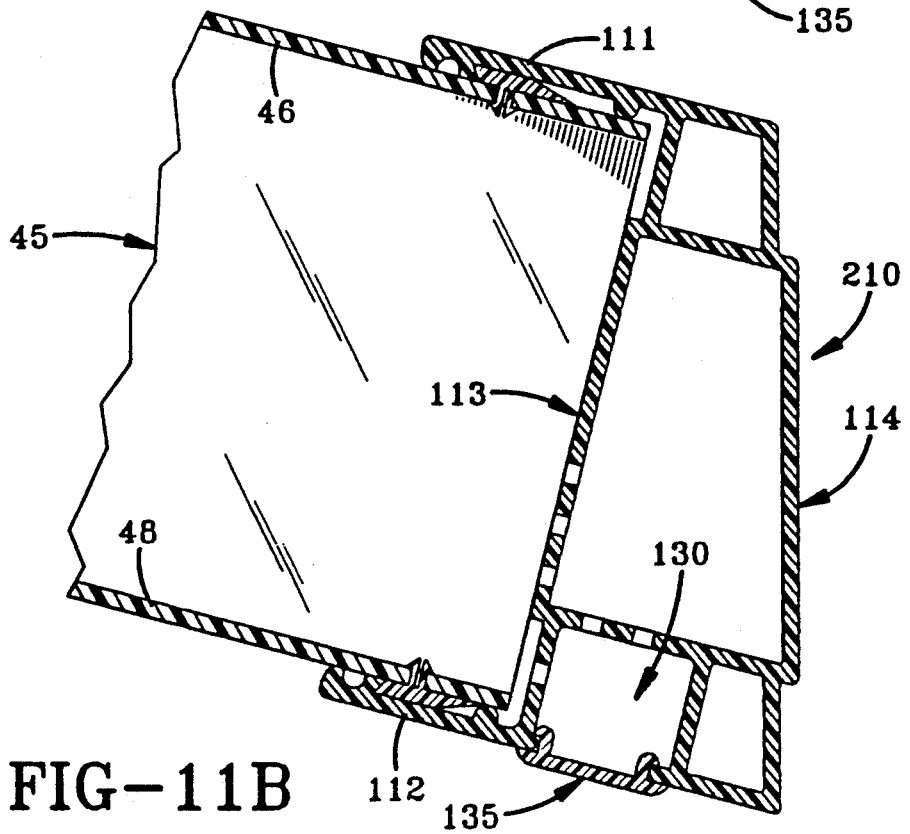

In order to effect cooperative interaction with the anchor strips 212 the mounting flanges 111 and 112 are preferably provided with a first spacing rib 221 formed along the outer edge thereof, as shown in FIG. 10, as well as a latch rail 222 and a second spacing rib 223. The second spacing rib 223A on mounting flange 111 is formed in proximity to the first step 124 of the base wall 113, and the second spacing rib 223B on mounting flange 112 is formed in proximity to the second step 125. The first spacing ribs 221 each serve as a follower which engages, and slides along, the inclined cam provided by the sloping leading edge 219 of the anchor strips 212 as the end cap 210 is mounted on the outer edge of the roof panel member 45. FIG. 11A depicts the initial engagement of the first spacing ribs 221 with the leading edge 219 of the anchor strips 212. The camming action that results as the eave cap 210 is moved in the direction of the arrows in FIG. 11A forces the mounting flanges 111 and 112 outwardly so that the latch rail 222 will move across the width of the anchor strip 212 and then drop behind, and in abutment with, the latching edge wall 220 of the respective anchor strips 212, as depicted in FIG. 11B. This insures that the eave cap 210 will be secured to, and retained on, the roof 44.

In the event that removal of the eave cap 210 is required, the outer ends of the mounted flanges 111 and 112 adjacent the first spacing rib 221 on each can be forced outwardly from the skin walls 46 and 48 on the roof panel members 45 until the latch rails 222 disengage from the latching edge walls 220. The eave cap 210 can then be removed and reinstalled, as desired.

It should be understood that an anchor strip 212 applied to only one skin wall 46 or 48 will generally suffice to secure the eave cap 210 for most applications, but the use of one or more anchor strips 212 on both skins 46 and 48, as shown, will assure the connection for even the most inhospitable environments.

Figure 12:
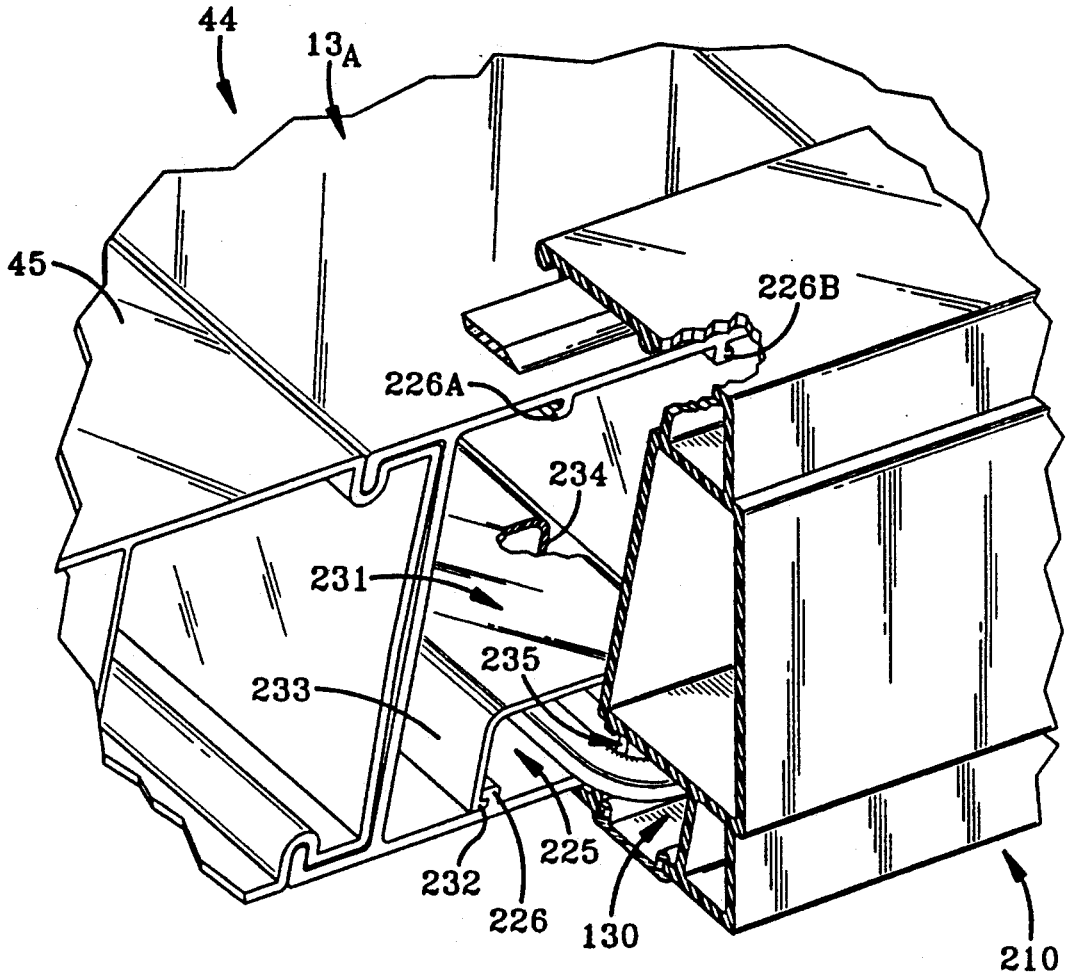

If one would choose to provide for the availability of electricity around the outer periphery of the roof 45, a cable, such as 224, can be strung within the race 130 provided in the eave cap 210, as shown in FIG. 12. The race cover plate 135 may be secured in the access aperture 131 by cooperation of the latching pawls 132 and 133 with the latching rails 138 and 139, as previously described.

The connector cap 110 and the eave cap 210 will both operatively engage the panel connectors 13 appropriate to the panel members 11 or 45. At least selected panel connectors $13_A$ may also incorporate a race 225. Provision for the race 225 is made by furnishing a laterally spaced pair of hooked latch pawls 226A and 226B on the inner surface 228 of at least one of the four walls 230A, 230B, 230C or 230D that define the panel connector $13_A$ depicted in conjunction with the wall $12_A$ in FIG. 7 as well as the roof 45 in FIG. 12. The opposingly directed latching fingers 232 on the outer edges of the side walls 233 and 234 of the U-shaped cover 231 can engage the hooked latch pawls 226 to secure the U-shaped cover 231 to the connector $13_A$ in order that the interior of the cover 231 will present the race 225.

Figure 7:
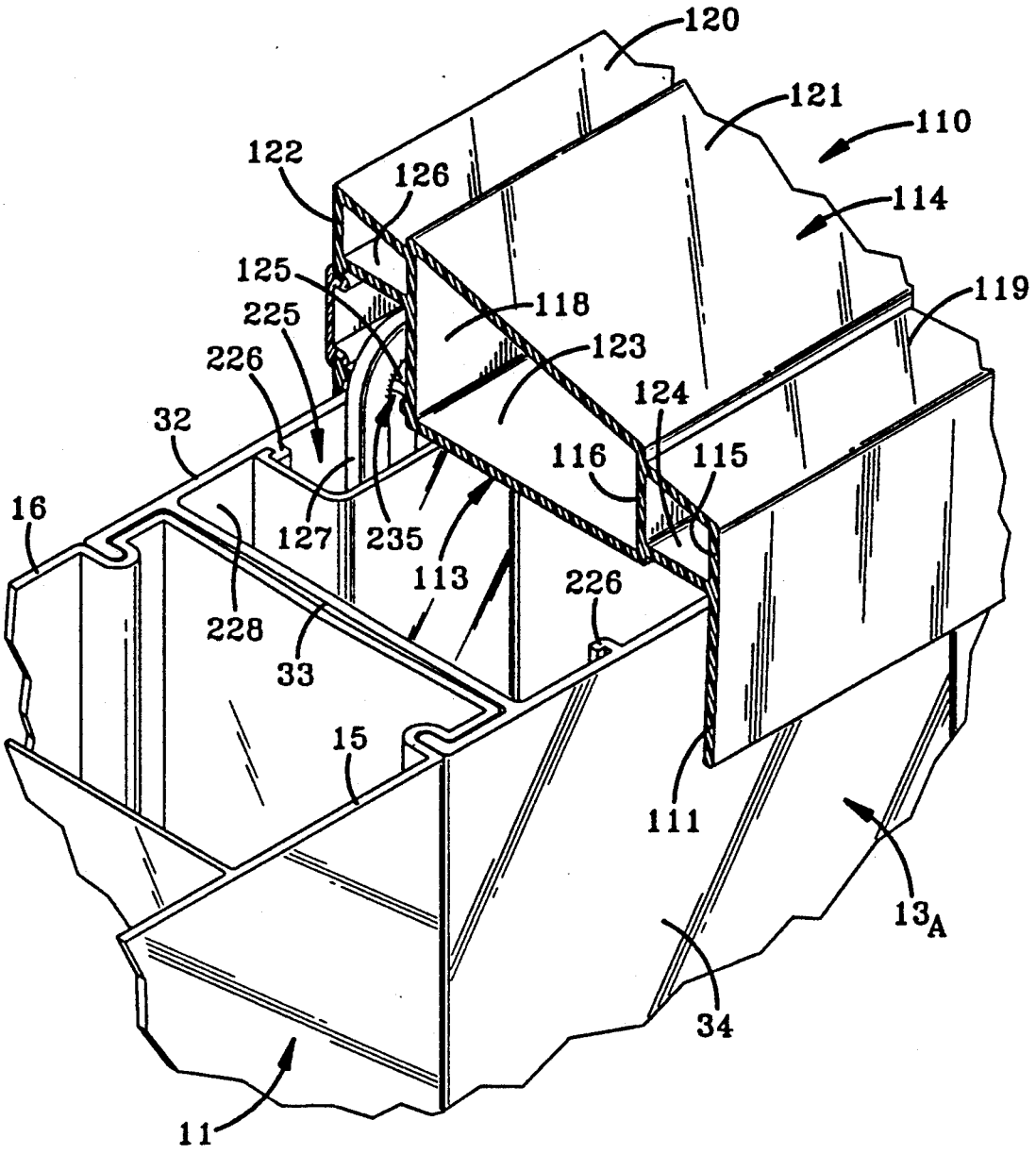
FIG. 7 is a perspective view taken along line 7—7 in FIG. 6 of a roof-to-wall connection made with an alternative embodiment of cap connector means according to the present invention.
Figure 8:
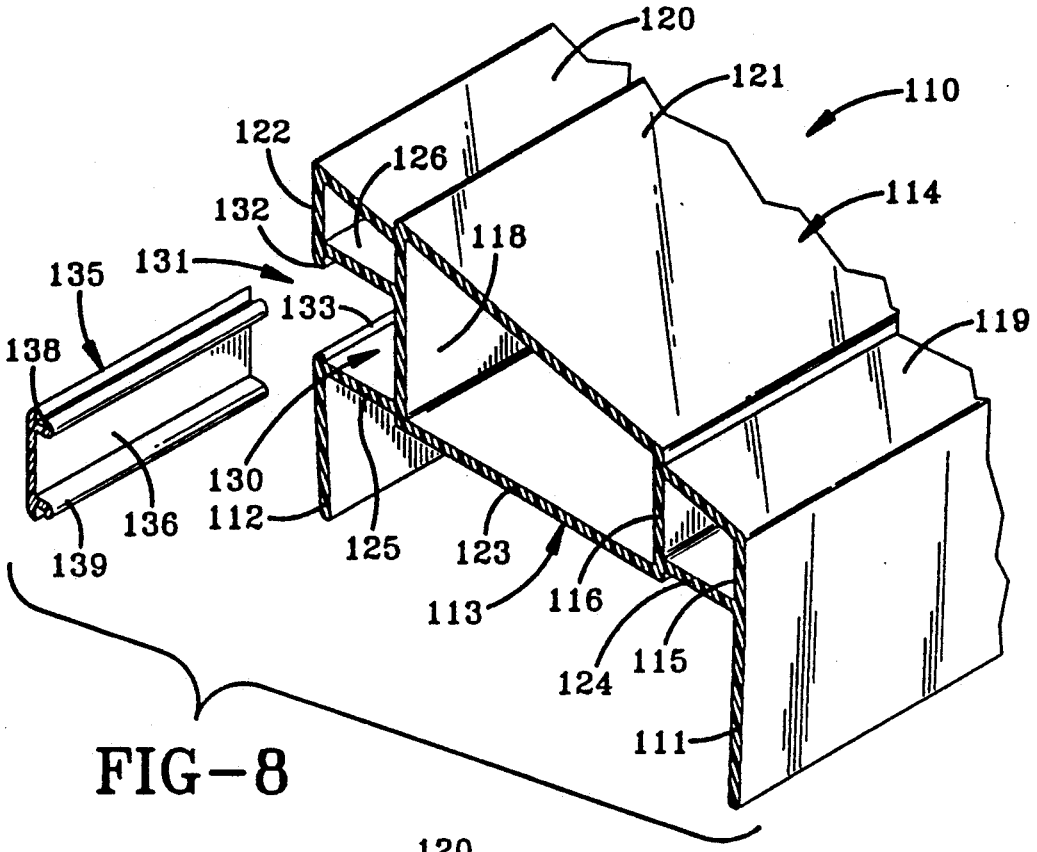
FIG. 8 is an exploded perspective of the alternative roof-to-wall cap connector means depicted in FIG. 7, with the race cover removed therefrom.
Figure 8A:
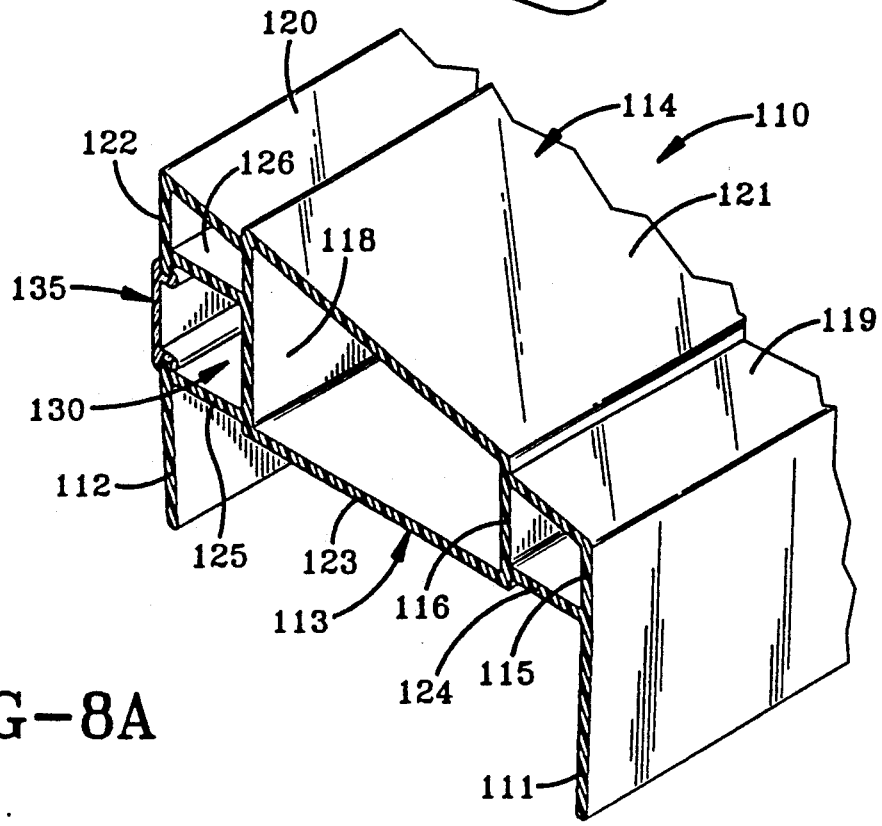
FIG. 8A is a perspective view similar to FIG. 8, but with the race cover assembled to the cap connector means.

Spaced apertures 235 penetrate the step 125 in the base wall 113 to afford access between the race 225 in the roof panel connector $13_A$ and the race 130 in the eave cap 210 (FIG. 12). Similarly spaced apertures 235 penetrate the step 125 in the base wall 113 to afford access between the race 225 in the wall panel connector $13_A$ and the race 130 in the cap connector 110 (FIG. 7). The apertures 235 thus permit the cable 127 to pass from a race 130 into a race 225. The ability to have electric cable available in the walls $12_A$ facilitates the provision of switches and outlets. The ability to have electric cable available in the roof 45 affords a convenient means by which to extend electrical service from one side of the building 105 to the other and also to permit the installation of ceiling lights at selected locations inside the building 105.

While the eave cap 210 has an overall shape similar to the connector cap 110, the connector cap 210 is not depicted as having the means to cooperate with the anchor strip 212. Should it be desired to effect a physical connection between the connector cap 110 and the wall $12_A$, the ribs 221 and 223 and the latch rail 222 can be added to one or both mounting flanges 111 and 112 on the connector cap 110 without adversely affecting the installation of the connector cap 110 to the wall $12_A$. When the structure of connector cap 110 is used as a roof support, the use of anchor strips 212 would be purely optional inasmuch as there is little necessity for further securing the connector cap 110 to the wall $12_A$ because weight of the roof 44, the anchor blocks 95 and dowels 55 would prevent the connector cap 110 from being inadvertently removed.

It should also be appreciated that the eave cap 210 may be provided without the inclusion of the race 130. The elimination of the race 130 from the eave cap 210 would allow a relatively uncomplicated way in which to effect the movement of air through the roof panel members 44. Specifically, a plurality of small pores 236 (FIG. 10) may penetrate appropriate portions of the base wall 113 and/or the reinforcing wall 118 to permit the interchange of air between the roof panels and the surrounding atmosphere. The pores 236 can be made sufficiently small such that a screen type structure is created.

The alternative embodiments depicted in FIGS. 7–12 are manufactured using the same techniques and materials as described above for the embodiment described in FIGS. 1–6, and also have the same advantages as the first described embodiment. The alternative embodiments also provide the advantage of permitting the easy installation and/or addition of electrical cable throughout the structure. The further advantage of the retaining means as described in conjunction with FIGS. 9–10 is available. The cap means described herein, whether for a roof-to-wall connection or to close an eave, employ the same basic structural arrangement.

The individual embodiments described herein have any number of distinguishing features, such as an electrical cable race integrally molded therein, and connector structures for securing the caps to the panel members. The modular panel members, whether roof or wall, are substantially identical in that they present outwardly facing central cavities which are closed by the base of the caps. The connector members for the modular panels may also have races to accommodate the routing of electrical cable. The central cavities of the modular wall panel members, as well as the cavity in the several wall connectors 13 or $\mathbf{13}_A$, can be filled with light mix concrete or expanding foam insulation, while the central cavities of the modular roof panel can be filled with expanding foam or other insulating materials depending upon the climate where the building is erected. In either event the filling of the central cavities can be accomplished after the modular wall is erected or the modular roof is in place on the wall end cap.

As should now be apparent, the present invention not only teaches that a roof anchor embodying the concepts of the present invention provides a means by which to secure a roof to a wall with mass produced structural components that can be utilized by unskilled labor without special tools. By employing the concepts of the present invention the roof can be erected and secured in place and in a far shorter time than the same job could be accomplished by traditional components and skilled labor. It should now also be apparent that the other objects of the present invention are likewise accomplished.

I claim:

1. A cap means in combination with modular panel member forming the walls or roof of a modular building structure, said modular panel member having at least one central cavity bounded by opposed, generally planar, skin walls, said central cavity being accessible from at least one end of said modular panel member, said cap means comprising:

a base resting upon a portion of said modular panel member in the modular building structure to cover the central cavity of said modular panel member;

an inclined plate portion supported from said base and presenting an outer uncovered surface of said cap means;

laterally spaced flange members extending from said base to embrace said modular panel member;

anchor strips;

said anchor strips having mounting means securing said anchor strips to said modular panel member;

a latching surface presented from said anchor strips; and, each said flange member having a latch rail for engaging said latching surface for retaining said cap means on said modular panel member.

2. A cap means, as set forth in claim 1, wherein:

each said flange member has a rib member extending longitudinally thereof; and, said anchor strip has a cam surface cooperating with said rib member for deflecting said flange member outwardly during assembly of said cap means on said modular panel member.

3. A cap means in combination with modular panel means forming the walls or roof of a modular building structure, said modular panel means having at least one central cavity bounded by opposed, generally planar, skin walls, said central cavity being accessible from at least one end of said modular panel means, said cap means comprising:

a base adapted to rest upon a portion of said modular panel means in the modular building structure so as to cover said central cavity of said modular panel means;

an inclined plate portion supported from said base and providing an outer surface for said cap means;

laterally spaced flange members extending outwardly from said base and having inner locating means engaging at least one of said skin walls of said modular panel means;

anchor strips; mounting means securing said anchor strips to said modular panel means;

latching means presenting an outwardly extending latch surface from said anchor strips; and, each said flange member having latch surface means for engaging the outwardly extending latch surface for retaining said cap means on said modular panel means.

4. A cap means and modular panel means, as set forth in claim 3, further comprising:

longitudinally extending channel means intermediate said base and said inclined plate portion defining a race for routing electrical cable along at least a portion of the length of the cap means; and, cover means including retaining means for closing said longitudinally extending channel means from the environment.

5. A cap means and modular panel means, as set forth in claim 3, wherein:

said locating means is defined by a pair of laterally spaced, longitudinally extending ribs;

said latch surface means is disposed between said ribs to define a surface oblique to one of the planar skin walls; and, said latching means defines an oblique surface disposed in abutment along the length thereof with said outwardly extending latch surface on respective ones of said flange members.

* * * * *